US006837220B2

(12) United States Patent
Hirano et al.

(10) Patent No.: US 6,837,220 B2
(45) Date of Patent: Jan. 4, 2005

(54) MULTIPLE CYLINDER ENGINE

(75) Inventors: Micho Hirano, Akashi (JP); Takao Sasamura, Akashi (JP); Minoru Nakamura, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 35 days.

(21) Appl. No.: 10/146,930

(22) Filed: May 17, 2002

(65) Prior Publication Data

US 2002/0170540 A1 Nov. 21, 2002

(30) Foreign Application Priority Data

May 21, 2001 (JP) ..... 2001-151676

(51) Int. Cl.[7] ..... F02M 69/54
(52) U.S. Cl. ..... 123/463
(58) Field of Search ..... 123/336, 463, 123/494

(56) References Cited

U.S. PATENT DOCUMENTS 5,231,958 A * 8/1993 Takahashi et al. ..... 123/73 A
5,924,409 A * 7/1999 Kato ..... 123/463
6,003,379 A * 12/1999 Ichikawa et al. ..... 73/708
6,227,172 B1 * 5/2001 Katayama et al. ..... 123/463
6,446,594 B2 * 9/2002 Watanabe et al. ..... 123/198 E

FOREIGN PATENT DOCUMENTS

| | | |
|---|---|---|
| JP | 59 035659 U | 3/1984 |
| JP | 59 107935 U | 7/1984 |
| JP | 61 132751 | 6/1986 |
| JP | 02 146237 | 6/1990 |
| JP | 02 227518 | 9/1990 |
| JP | 09242576 | 9/1997 |

* cited by examiner

*Primary Examiner*—Tony M. Argenbright
(74) *Attorney, Agent, or Firm*—Oliff & Berridge, PLC

(57) ABSTRACT

A multiple cylinder engine controls an air/fuel ratio accurately by improved detection of the fluctuations in a vacuum due to a change in the openings of throttle valves. The multiple cylinder engine includes a plurality of intake passages that independently feed intake air to cylinders; fuel injectors; throttle valves; a pressure sensor; and a fuel controller that controls fuel injection of each cylinder using the detected pressure. The multiple cylinder engine may further include a vacuum inlet passage having an inlet port opened into intake passages that introduces the pressure of the intake passages into the pressure sensor. The vacuum inlet passage preferably includes a throttle portion having a passage area of no more than one ninth that of the inlet port.

6 Claims, 9 Drawing Sheets

MULTIPLE CYLINDER ENGINE

BACKGROUND OF THE INVENTION

1. Field of Invention

The present invention relates to a multiple cylinder engine such as a V-type 2-cylinder engine and, more particularly, to a multiple cylinder engine capable of controlling an air/fuel ratio accurately.

2. Description of Related Art

In a small general-purpose engine to be used in an agricultural machine, a small-sized power generator or the like, a carburetor is generally employed in an intake system of the engine. In case there is considered the response of the engine at its acceleration/deceleration, the countermeasures against exhaust emissions of recent years and the homogeneous distribution of mixtures, however, it is thought that a fuel injection device (especially, an electronic control type fuel injection system) for injecting fuel directly into the intake pipe is advantageous over the carburetor. From this background, the fuel injection device is being adopted at present.

Here will be briefly described the construction of the fuel injection device by exemplifying a fuel injection type V-type engine for adjusting a fuel injection quantity by measuring an intake pipe vacuum downstream of a throttle valve and by converting the measured vacuum into an intake air flow. This fuel injection device is constituted, as shown in FIG. 9, to include a fuel injection valve 81, a fuel pressure adjustor 82 and a pressure sensor 83 shared by individual cylinders 80 and 80. An intake passage 84, as shared by the individual cylinders 80 and 80, and the fuel pressure adjustor 82 are connected by conduit 86. The intake passage 84 and the pressure sensor 83 are connected by conduit 85. The pressure sensor 83 has a vacuum inlet port 85*a*, which is opened into the intake passage 84 downstream of a throttle valve 87.

In the case of this constitution, the intake pressure is averaged conveniently for the fuel pressure adjustor 82, even if it is introduced from the intake passage 84 shared by the two cylinders into the single fuel pressure adjustor 82. As the peaks of the intake pressure of the intake pipe are excessive close on the time axis, however, they are unclear for the pressure sensor 83 to detect, so that the accuracy of the injection quantity control is deteriorated.

SUMMARY OF THE INVENTION

Accordingly, it is an object of the present invention to provide a multiple cylinder engine capable of controlling an air/fuel ratio accurately by accurately detecting the fluctuations of a vacuum in an inlet passage of the engine, due to a change in the openings of throttle valves.

According to the first aspect of the present invention, a multiple cylinder engine comprises: a plurality of cylinders; a plurality of intake passages for feeding intake air to the individual cylinders independently of each other; a fuel injector provided for each intake passage; a throttle valve provided for each intake passage; a pressure sensor for detecting the pressure of one of the intake passages; and fuel control means for controlling the injection quantity of the fuel injector of each cylinder by using the detected pressure.

According to aspects of the present invention, the pressure sensor detects the vacuum from one of the intake passages provided independently for each cylinder. With this the detection is not influenced by another cylinder so that it can detect the vacuum accurately. Therefore, the detection accuracy of the intake air flow based on the vacuum is improved, which increases the accuracy of the fuel control by the fuel control means on the basis of the vacuum. Here, an intake air flow of the intake passage, in which the vacuum is not detected, can be obtained from the vacuum in the intake passage, in which the vacuum is detected. The intake air flow of the intake passage, in which the vacuum is not detected, is obtained by predetermining its ratio to the intake air flow of the intake passage, in which the vacuum is detected, and by storing the determined data in the fuel control means.

Preferably, the multiple cylinder engine further comprises a vacuum inlet passage having an inlet port opened in the intake passage for introducing the pressure of the intake passage into the pressure sensor, and the vacuum inlet passage includes a throttle portion having a passage area of one ninth or less as large as that of the inlet port.

Thus, if a dynamic pressure is detected at the time of detecting the vacuum value, the peak values and the bottom values of the waveforms of the pressure fluctuations become unclear so that the fluctuations of the vacuum in the air intake passage due to the small change in the openings of the throttle valves are hard to detect. As a result, it is difficult to control the air/fuel ratio accurately. However, with the above structure, the vacuum inlet passage is provided with the throttle portion so that the waveforms of the pressure fluctuations, as might otherwise be made unstable by the influence of the dynamic pressure, are stabilized to clarify the peak values and the bottom values of the waveforms obtained thereby to improve the accuracy of the vacuum detection by the pressure sensor. As a result, it is possible to control the air/fuel ratio accurately. Moreover, the passage area of the throttle portion is set to one ninth or less of that of the inlet port so that the fluctuations of the vacuum due to the small change of the throttle valve opening can be tolerated to detect the vacuum accurately.

Preferably, a throttle body forming a section of the intake passage and having the throttle valve and an intake port of the cylinders is connected by an intake manifold, and the vacuum inlet passage is formed in the throttle body and a outlet portion of the vacuum inlet passage is formed in the mating face of the throttle body with the intake manifold.

Thus, the vacuum inlet passage leading to the pressure sensor and the section of the intake passage communicating with the vacuum inlet passage are formed in the throttle body so that a separate member for forming the vacuum inlet passage and mounting parts such as bolts can be eliminated to reduce the number of parts and to facilitate the assembly. Moreover, a outlet portion of the vacuum inlet passage is positioned in a mating face in the throttle body with the intake manifold so that this portion can be easily formed.

Preferably, the multiple cylinder engine further comprises a fuel pressure adjustor for adjusting the pressure of the fuel to be fed to the fuel injectors. A pressure introduction passage is formed in the throttle body or in the intake manifold for introducing the pressure of the each intake passage into the fuel pressure adjustor. The pressure introduction passage has its leading end portion positioned in the mating face between the throttle body and the intake manifold.

Thus, the pressure introduction passage is formed in the throttle body or in the intake manifold, and its leading end portion is positioned in the mating face between the throttle body and the intake manifold so that separate members for forming those passages and mounting parts such as bolts can be eliminated to reduce the number of parts and to facilitate the assembly. Moreover, the pressure introduction passage has its leading end portion positioned in the mating face between the throttle body and the intake manifold so that it can be easily formed.

Preferably, the leading end portion includes an expansion chamber and an introduction port for connecting the expansion chamber to the each intake passage. The introduction port has a passage area set smaller than a maximum passage area of the expansion chamber.

Thus, air introduced from the intake passages into the introduction port is averaged gently in its pressure by the expansion chamber. When the air is introduced from the expansion chamber into the fuel pressure adjustor, therefore, the fuel pressure can be adjusted to the optimum by the fuel pressure adjustor.

BRIEF DESCRIPTION OF THE DRAWINGS

FIG. 2 is a front elevation showing an essential portion of the V-type 2-cylinder engine according to the same embodiment, and shows an arrangement of a throttle body, a fuel pressure adjustor, a fuel introduction pipe and so on;

FIG. 3 is a longitudinal section of an essential portion of the V-type 2-cylinder engine according to the same embodiment, and shows an intake passage, a fuel passage and so on;

DETAILED DESCRIPTION OF PREFERRED EMBODIMENTS

Figure 1:
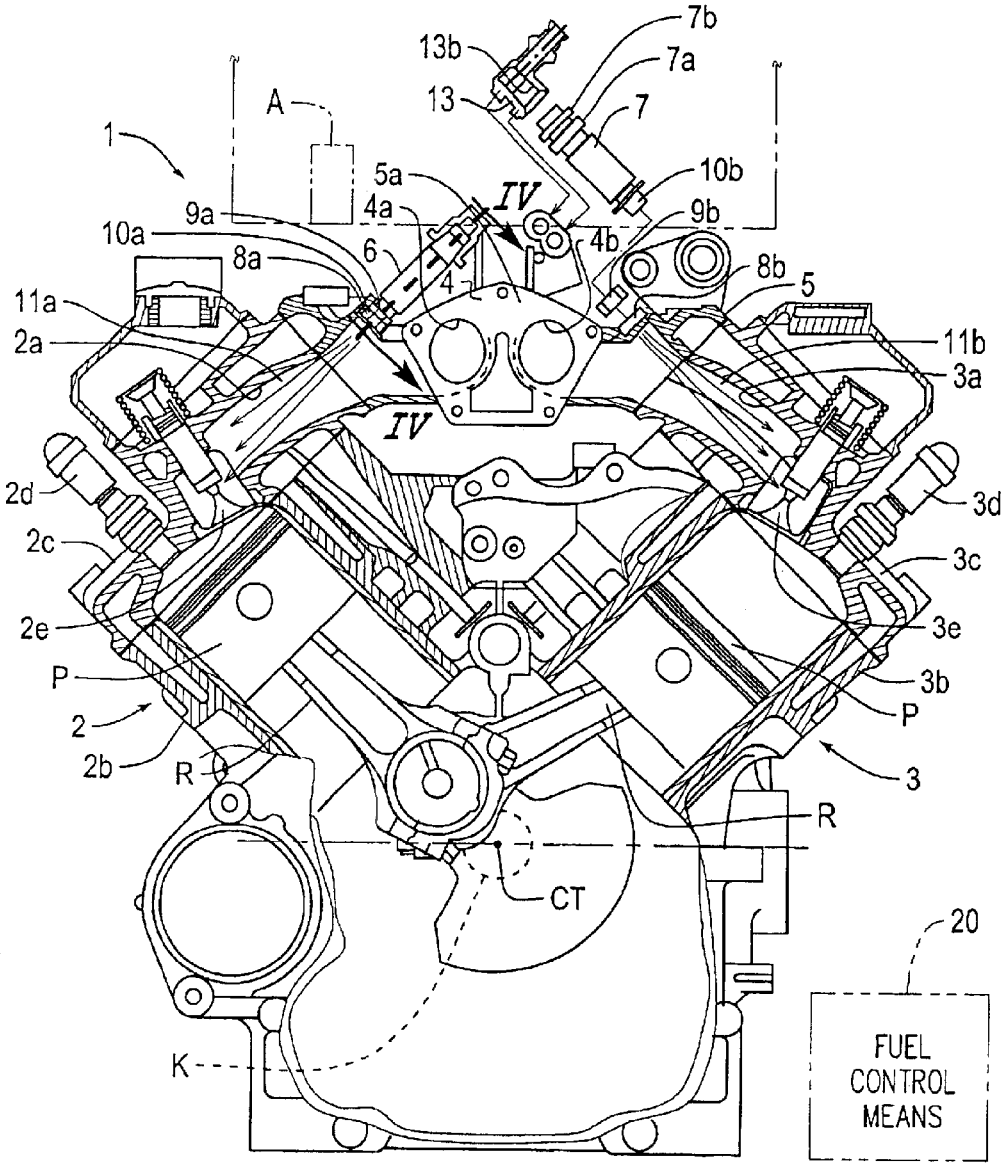
FIG. 1 is a sectional front elevation showing a V-type 2-cylinder engine according to an embodiment of the present invention.

A V-type 2-cylinder engine according to an embodiment of the present invention will be described with reference to FIG. 1 to FIG. 5. In FIG. 1, the V-type 2-cylinder engine 1 is a general-purpose engine to be used in an industrial machine, an agricultural machine or the like. The V-type 2-cylinder engine 1 includes: cylinders 2 and 3 arranged in the V-shape at different angle (e.g., 90 degrees) positions around a crank axis CT; a throttle body 4 (although only its front end flange portion is shown) arranged in the V-shaped space (or the bank space) between those cylinders 2 and 3; and an intake manifold 5 interposed between the throttle body 4 and the intake ports 2*a* and 3*a* of the two cylinders 2 and 3. The throttle body 4 is connected, as shown in FIG. 3, to an upper air cleaner D through an intake duct member 15 which is mounted on a front end flange face 4*e*. On the bottom portion of the air cleaner D, there is mounted an intake temperature sensor A for detecting the temperature of the cleaned air in the air cleaner D.

The individual cylinders 2 and 3 shown in FIG. 1 are provided with cylinder bodies 2*b* and 3*b*, in which pistons P are slidably fitted, and cylinder heads 2*c* and 3*c*. These cylinder heads 2*c* and 3*c* are provided with ignition plugs 2*d* and 3*d* and intake valves 2*e* and 3*e*. The reciprocal motions of the pistons P are transmitted as rotational motions through a connecting rod R to a crankshaft K.

Between the individual cylinders 2 and 3, moreover, there are mounted fuel injectors 6 and 7, which are inclined and have their leading end nozzles 10*a* and 10*b* oriented obliquely downward to the outer side. These fuel injectors 6 and 7 are individually mounted in mounting holes 8*a* and 8*b*, which are formed at symmetrical positions in the intake manifold 5, through ring-shaped rubber seals 9*a* and 9*b* with the leading end nozzles 10*a* and 10*b* being directed toward the intake ports 2*a* and 3*a* of the individual cylinders 2 and 3.

In the V-type 2-cylinder engine 1, moreover, there are formed two intake passages 11*a* and 11*b* for feeding the intake air independently to the individual cylinders 2 and 3. The throttle body 4 is provided with two intake passages 4*a* and 4*b* forming sections of the intake passages 11*a* and 11*b*. As shown in FIG. 3, the intake passages 4*a* and 4*b* are individually provided therein with throttle valves 4*c*. In the intake duct member 15, too, there are formed two intake passages 15*a* and 15*b* which communicate with the intake passages 4*a* and 4*b* to form sections of the intake passages 11*a* and 11*b*.

Figure 3:
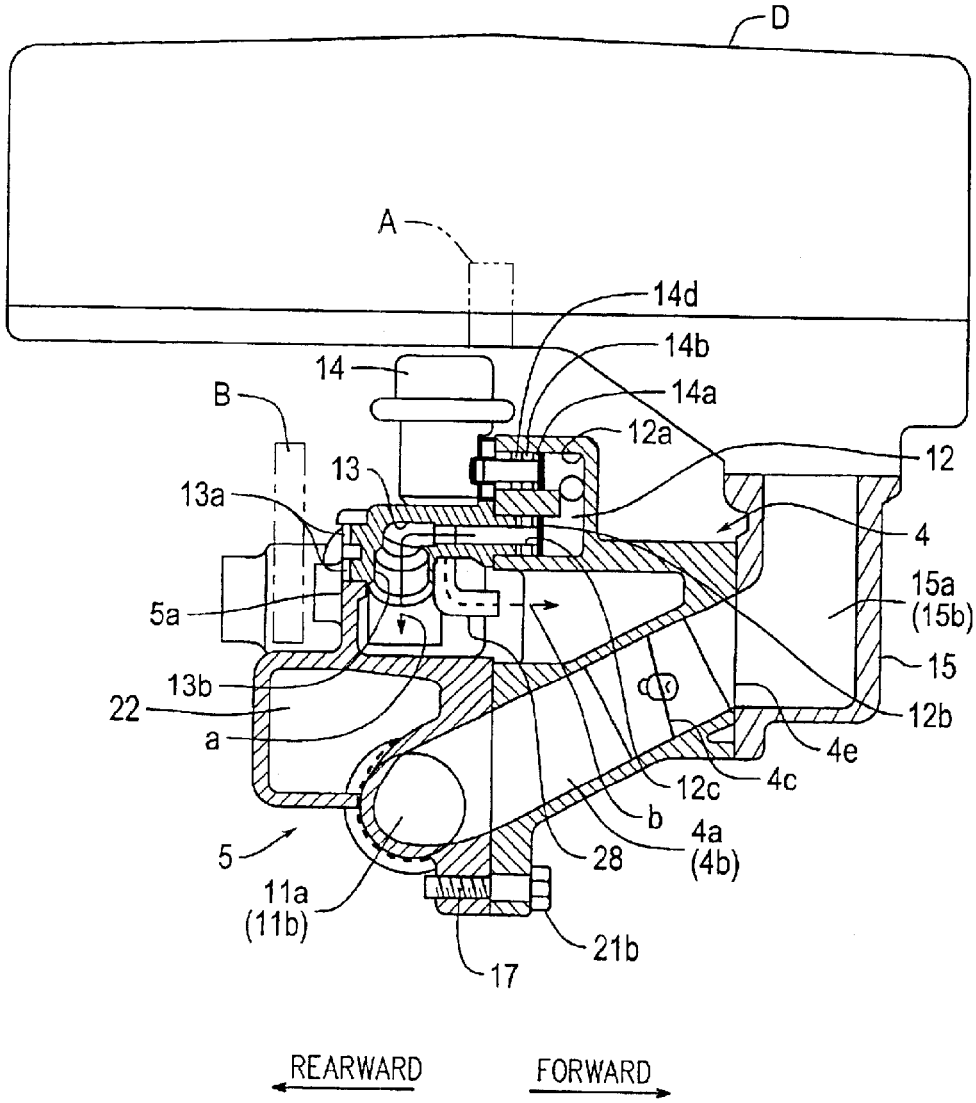
Figure 4:
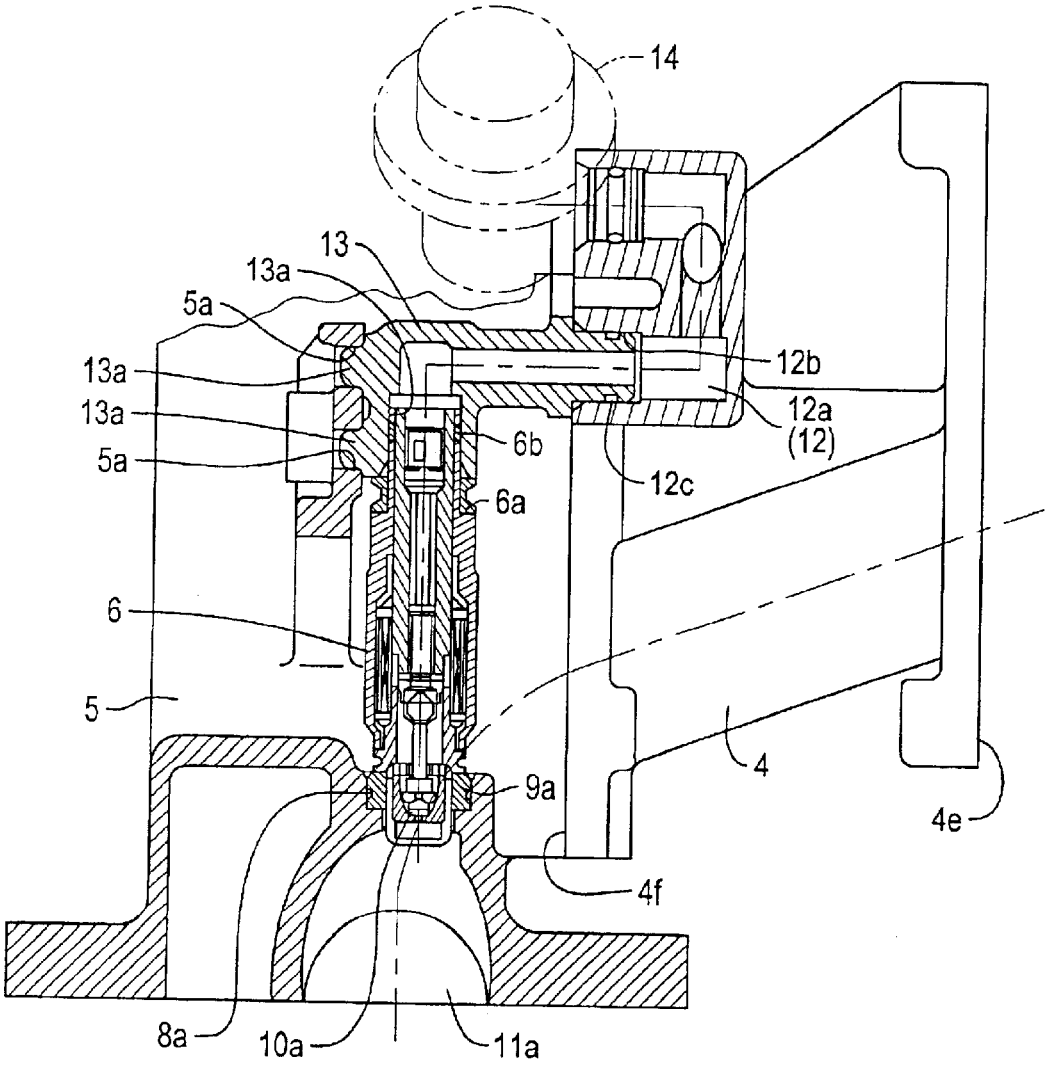
FIG. 4 is a sectional view of line IV—IV of FIG. 1.

On the upper side of the throttle body 4, there is disposed an injection fuel introduction portion 12*a* of a fuel passage 12. Two fuel introduction pipes 13 for feeding the fuel from the injection fuel introduction portion 12*a* to the fuel injectors 6 and 7 (FIG. 1) are fitted and supported between the throttle body 4 and the intake manifold 5 respectively. The fuel introduction pipes 13 are supported in such a manner that protrusions 13*a* formed at one-side end of the fuel introduction pipe 13 is inserted into a positioning hole 5*a* formed in the intake manifold 5, and a leading end portion of the fuel introduction pipe 13 is inserted into a fuel introduction pipe mounting hole 12*b* formed in the fuel introduction portion 12*a* through O-rings 12*c*, as shown in FIG. 4. As a result, the fuel introduction pipes 13 are supported between the throttle body 4 and the intake manifold 5. Moreover, the throttle body 4 and the intake manifold 5 are fixed by bolts 21*b* which are fastened in threaded holes 17 of the intake manifold 5 shown in FIG. 3.

Figure 5:
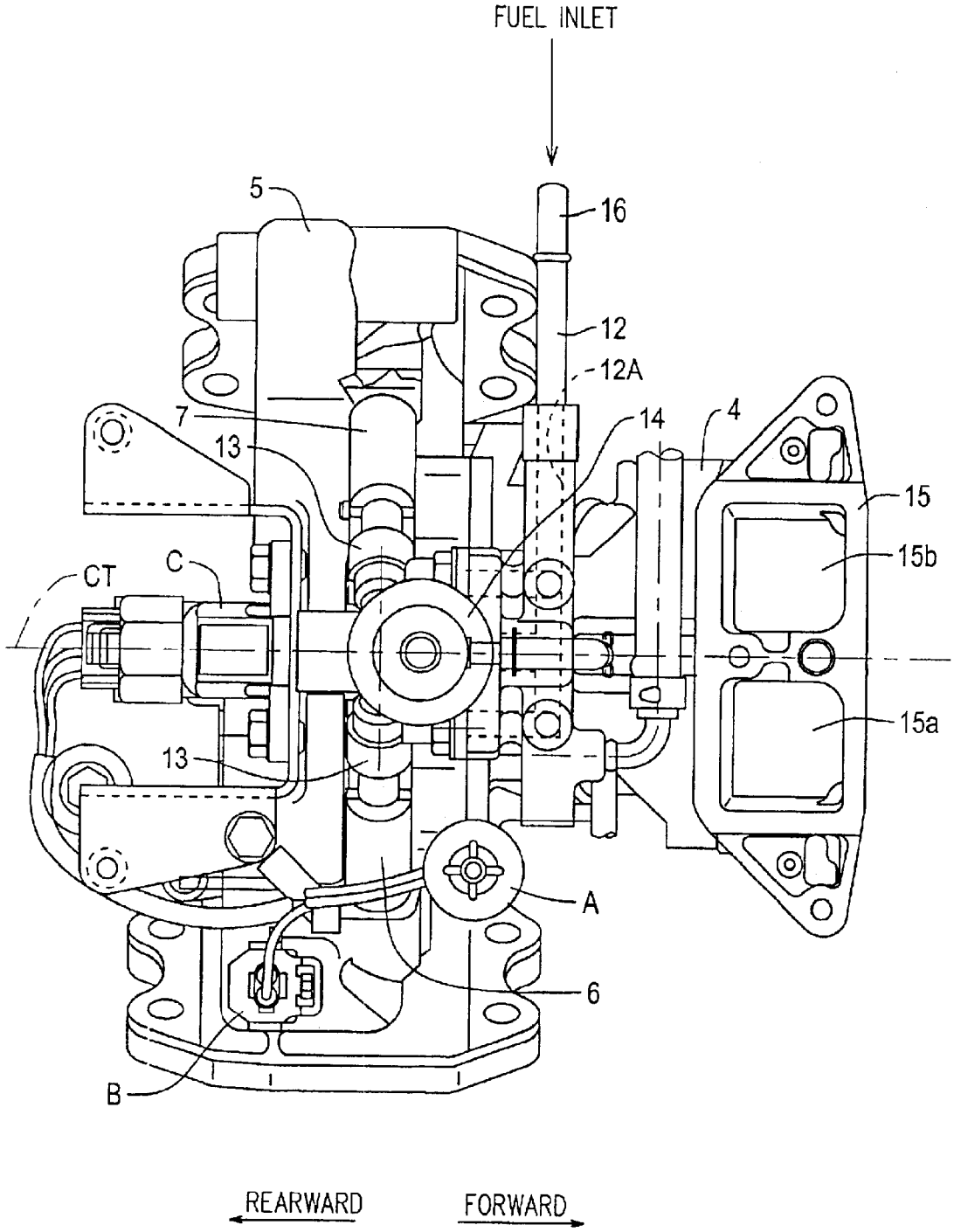
FIG. 5 is a top plan view showing an essential portion of the V-type 2-cylinder engine according to the embodiment of the present invention.
Figure 6:
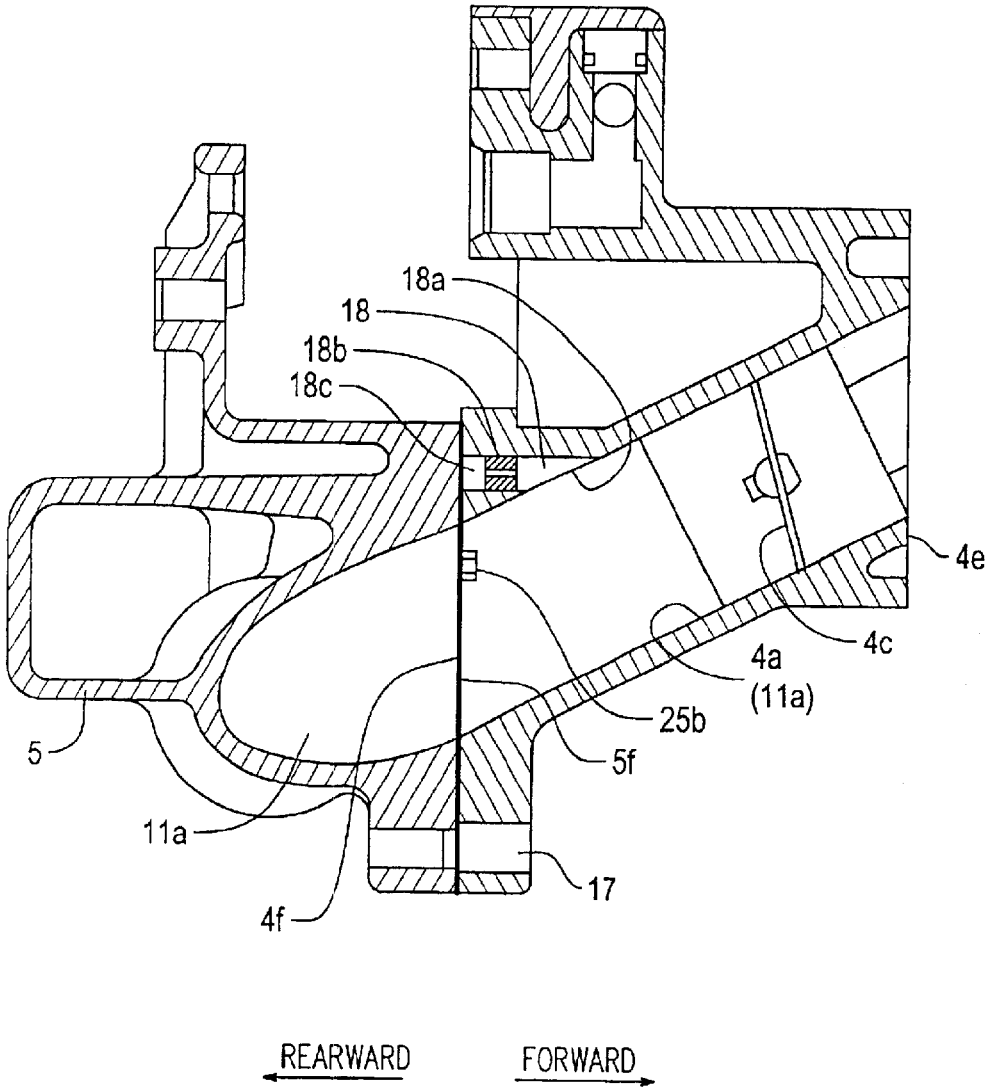
FIG. 6 is a sectional view taken along line VI—VI of FIG. 2, to which an intake manifold is added.

In the upper portion of the throttle body 4, moreover, there is formed a vacuum inlet passage 18 of FIG. 6 for extracting the intake pressure of the intake passage 11*a* downstream of the throttle valve 4*c*, and the leading end of the vacuum inlet passage 18 is connected to a pressure sensor C (FIG. 7) so that the intake pressure in one intake passage 11*a* (or the other intake passage 11*b*) can be detected by the pressure sensor C. This pressure sensor C is mounted on the back portion of the intake manifold 5 through a bracket 19, as shown in FIG. 5. The pressure value detected by the pressure sensor C is sent as a detection signal to a computer 20 of FIG. 1 or fuel control means. With a map programmed in advance in the computer 20, the fuel injection rates of the fuel injectors 6 and 7 of the individual cylinders 2 and 3 are determined from the relationship between the pressure value and the engine speed rpm. In this determination of the fuel injection rates, the detection data of the intake temperature sensor A and a water thermometer B inserted in a cooling water passage 22 shown in FIG. 3 are also inputted to the computer 20 so that the injection rates of the fuel are corrected.

On the other hand, the fuel injectors 6 and 7 shown in FIG. 1 are inserted between the fuel introduction pipes 13 and the intake manifold 5 and supported in a sealed state such that their leading end nozzles 10*a* and 10*b* are supported through the rubber seals 9*a* and 9*b* in the mounting holes 8*a* and 8*b* of the intake manifold 5 and such that their root end sides are inserted into the fuel injector inserting holes 13*a* of the fuel introduction pipes 13 through shock absorbing dampers 6*a* and O-rings 6*b*, as described by representing the case of the fuel injector 6 in FIG. 4. Here, the injection fuel introduction portion 12*a* is desirably formed integrally with the throttle body 4, but may also be constructed by making it as a separate member and by mounting it on the throttle body 4 by mounting means such as fasteners.

Figure 2:
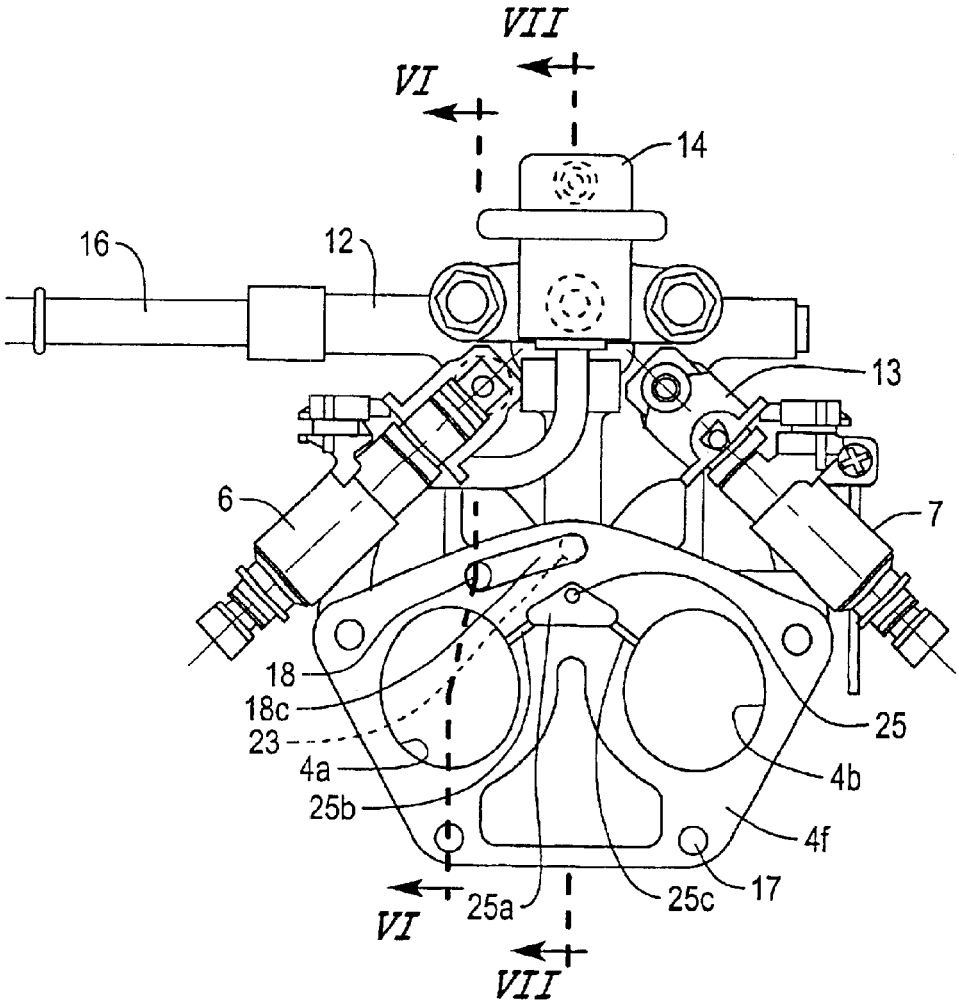

Between and slightly over the fuel injectors 6 and 7, as shown in FIG. 2, there is mounted a common fuel pressure adjustor 14 for adjusting the pressure of the fuel to be fed to the fuel injectors 6 and 7. This fuel pressure adjustor 14 is connected in a sealed state, as shown in FIG. 3, by mounting a bypass pipe portion 14*a* extended from its front portion (as located on the right side of FIG. 3) through an O-ring 14*b* in a fuel pressure adjustor mounting hole 4*d* formed in the throttle body 4, and is mounted on the throttle body 4 by means of not-shown bolts.

Moreover, the fuel pressure adjustor 14 is arranged, as shown in a top plan view in FIG. 5, on one side (or the front side) across the fuel injectors 6 and 7 in the longitudinal direction along the rotation axis CT of the engine. On the other side (or the rear side), there is arranged the pressure sensor C for detecting the pressure in the intake passages 11*a* and 11*b*. As shown in FIG. 5, the fuel in the fuel tank (although not shown) is introduced through the injection fuel introduction portion 12*a* into the fuel introduction pipes 13 of FIG. 3 by attaching the fuel pipe from the fuel tank to a fuel connection pipe 16 which is connected to the injection fuel introduction portion 12*a* in the throttle body 4. As shown in FIG. 3, the fuel introduced into the injection fuel introduction portion 12*a* flows, as indicated by a solid arrow a, from the fuel introduction pipes 13 into the fuel injectors 6 and 7 (FIG. 2), whereas the excess fuel is returned, as indicated by a dotted arrow b, from the fuel pressure adjustor 14 via a return passage 28 to the fuel tank. With this arrangement, the fuel injection type V-type 2-cylinder engine can be easily reconstructed by replacing the carburetor of the general carburetor type V-type 2-cylinder engine and the manifold for the carburetor, by the throttle body 4 and the intake manifold 5. In accordance with the needs, therefore, the specifications can be quickly changed from the carburetor type to the fuel injection device type of the invention.

At an intake stroke of the V-type 2-cylinder engine thus constructed, as the intake valves 2*e* and 3*e* shown in FIG. 1 are opened and the pistons P go down, the pressures in the cylinders 2 and 3 drop so that the air is sucked from the intake passages 11*a* and 11*b* formed in the throttle body 4 and the intake manifold 5. At this time, the intake vacuum of the sucked air is detected in a high accuracy by the pressure sensor C (FIG. 5), and the detected value obtained is inputted together with the engine speed to the computer 20 or the fuel control means so that the fuel injection rate is determined. At this time, the detected data of the intake temperature sensor A and the water thermometer B (FIG. 3) are also inputted to the computer 20 to correct the injection rates determined. On the basis of the instructions of the computer 20, moreover, the injection rates by the fuel injectors 6 and 7 are controlled, and the fuels in the controlled injection rates are injected from the fuel injectors 6 and 7 into the intake passages 11*a* and 11*b* of the intake manifold 5 so that the optimum mixtures are homogeneously distributed and fed to the cylinders 2 and 3.

Here, the fuel injectors 6 and 7 are individually provided for each cylinder 2 and 3 in the V-space of the engine so that the mixtures can be homogeneously distributed. Moreover, not only the fuel injectors 6 and 7 but also the accompanying fuel pressure adjustor 14 is arranged in the V-space, and the intake passages 11*a* and 11*b* and the fuel passage 12 are integrally formed in the throttle body 4 and the intake manifold 5, so that the pipes to be employed can be reduced to the necessary minimum to make a compact structure as a whole. Moreover, the fuel injectors 6 and 7 and the fuel introduction pipes 13 are mounted on the throttle body 4 and the intake manifold 5 by not fastening but inserting them, so that their mountability and assembling performance are improved.

Figure 7:
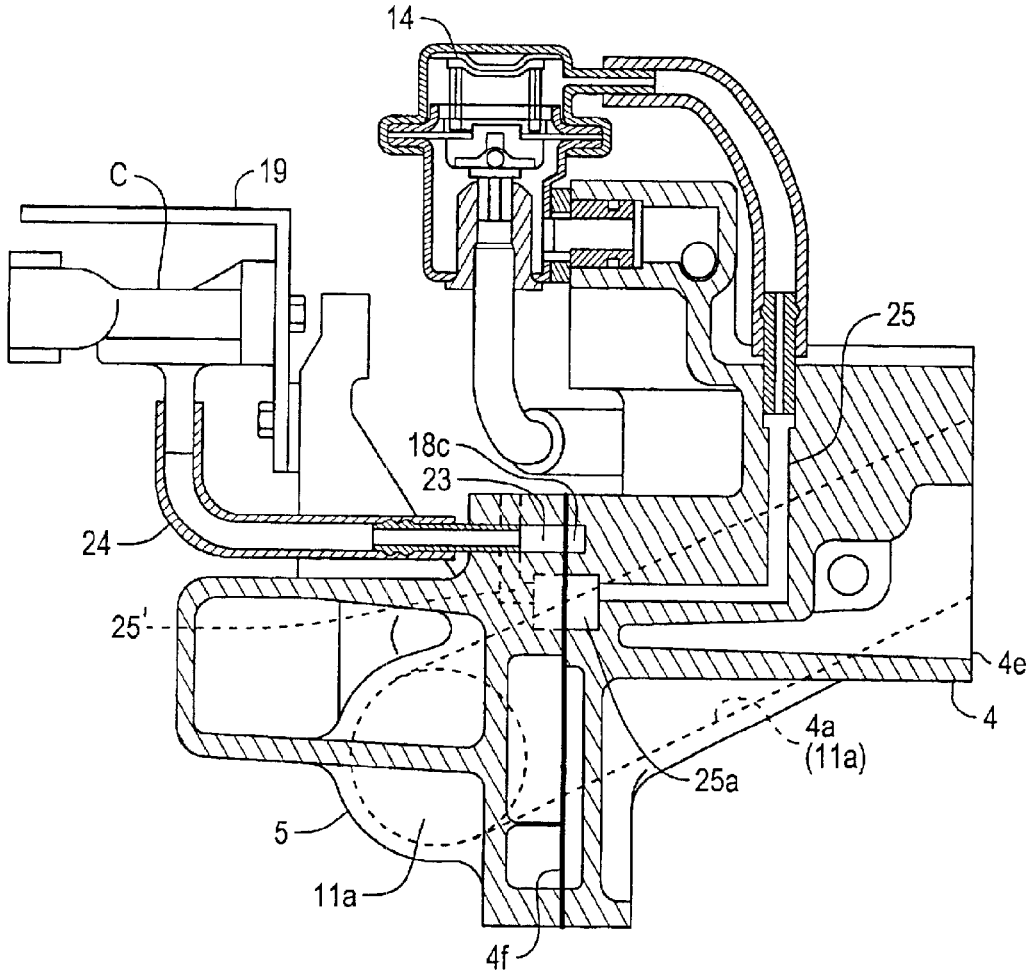
FIG. 7 is a sectional view taken along line VII—VII of FIG. 2, to which the intake manifold is added.

FIG. 6 and FIG. 7 describe the detail of the vacuum extracting portions of the intake passages. In order to make the details of the vacuum inlet passage 18 especially understandable, however, the fuel injectors 6 and 7 and the fuel pressure adjustor 14 are omitted in FIG. 6 and FIG. 7 for convenience.

In FIG. 6, the vacuum inlet passage 18 is formed by extending it normal to a flange face 4*f* of a mating face with the intake manifold 5 in the throttle body 4. The vacuum inlet passage 18 is provided at its one end with an inlet port 18*a* opened into one intake passage 4*a* (or 11*a*) and at its other end with a thin groove 18c of FIG. 2 (outlet portion of the vacuum inlet passage) opened in the flange face 4*f*. One end portion of the groove 18*c* is connected, as shown in FIG. 7, to the pressure sensor C through a communication passage 23 formed in the intake manifold 5 and through a connection pipe 24. In the vacuum inlet passage 18, as shown in FIG. 6, there is formed a throttle portion 18*b* which has a passage area set to about one ninth or less as large as the passage area of the inlet port 18*a*. If the passage area of the throttle portion 18*b* exceeds about one ninth of that of the inlet port 18*a*, the vacuum value to be detected by the pressure sensor C (FIG. 7) may be made unstable by the influences of a dynamic pressure.

As a passage for detecting a controlling vacuum to control the fuel pressure adjustor 14 of FIG. 7, on the other hand, there is formed in the throttle body 4 a pressure introduction passage 25 for introducing the pressure in the intake passages 11*a* and 11*b* into the fuel pressure adjustor 14. This pressure introduction passage 25 is positioned at its portion or leading end portion at a mating face 5*f* with the throttle body 4 in the intake manifold 5. The leading end portion is opened in the flange face 4*f* of the throttle body 4. This leading end portion is provided, as shown in FIG. 2, with an expansion chamber 25*a*, and introduction ports 25*b* and 25*c* for connecting the expansion chamber 25*a* and the intake passages 4*a* and 4*b*. The passage area of the introduction ports 25*b* and 25*c* is set smaller than the maximum passage area of the expansion chamber 25*a*. Here, the passage area of the expansion chamber 25*a* is a sectional area normal to the air flow in the expansion chamber 25*a*. Moreover, the introduction ports 25*b* and 25*c* are formed to have small sections, and the expansion chamber 25*a* is desired to have a passage area of at least five times that of the introduction ports 25*b* and 25*c*.

Both the vacuum inlet passage 18 of FIG. 6 and the expansion chamber 25*a* of FIG. 7 are formed in the direction normal to the flange faces 4*f* and 5*f* of the mating face between the throttle body 4 and the intake manifold 5, so that they can be easily machined.

A detection path of the control vacuum for controlling the fuel pressure adjustor 14 is formed in the throttle body 4, but a pressure introduction passage 25' may be formed in the intake manifold 5, as indicated by phantom lines of FIG. 7. Moreover, the detection path may be formed over the intake manifold 5 and the throttle body 4 by forming, for example, only the introduction ports 25*b* and 25*c* in the intake manifold 5 and by forming the remaining portion in the throttle body 4.

According to the vacuum detecting means thus constructed, the pressure detected by the pressure sensor C of FIG. 7 is the vacuum from one intake passage 4*a* (or 11*a*) but not the vacuums from a plurality of intake passages, and the vacuum is not averaged so that it can be accurately detected.

Therefore, the detection accuracy of the intake air flow based on the vacuum is improved to increase the accuracy of the fuel control by the computer 20 (FIG. 1) on the basis of the vacuum. Here, the intake air flow of the intake passage 11*b*, the vacuum of which is not detected, can be easily obtained from the vacuum, i.e., the intake air flow of the intake passage 11*a*, the vacuum of which is detected, by predetermining the ratio of the intake air flow of the intake passage 11*a* and the intake passage 11*b* and by storing the ratio data in the computer 20.

Figure 8A:
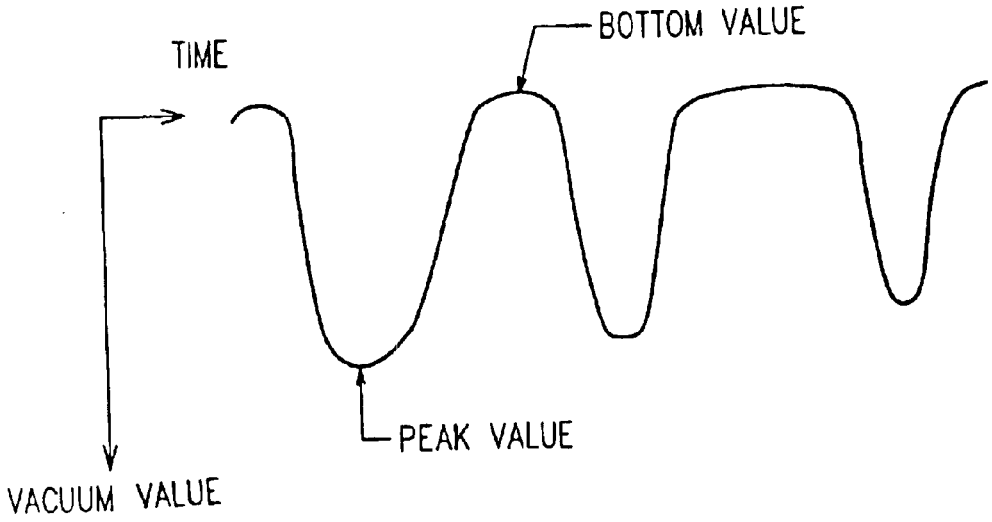
FIGS. 8(A) and 8(B) are diagrams illustrating relationships between a vacuum value on pressure fluctuations and the time with and without a throttle portion in a vacuum outlet passage.
Figure 8B:
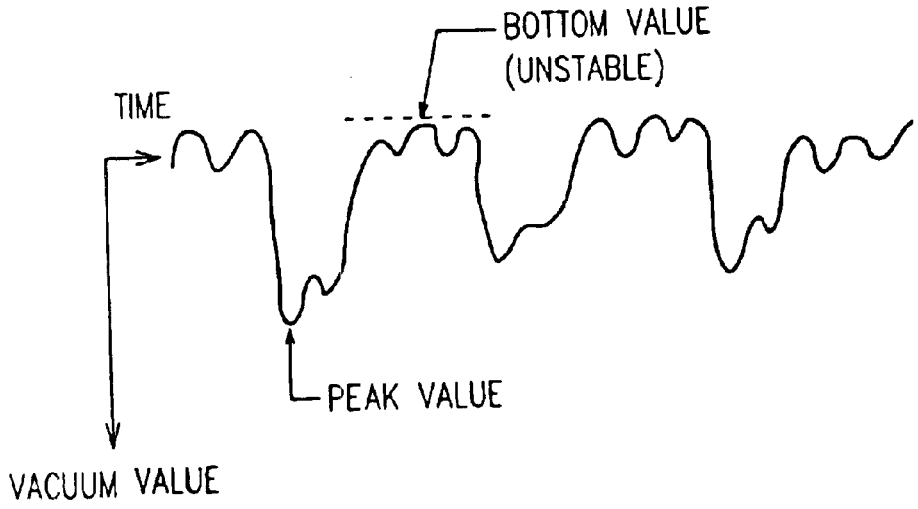
Figure 9:
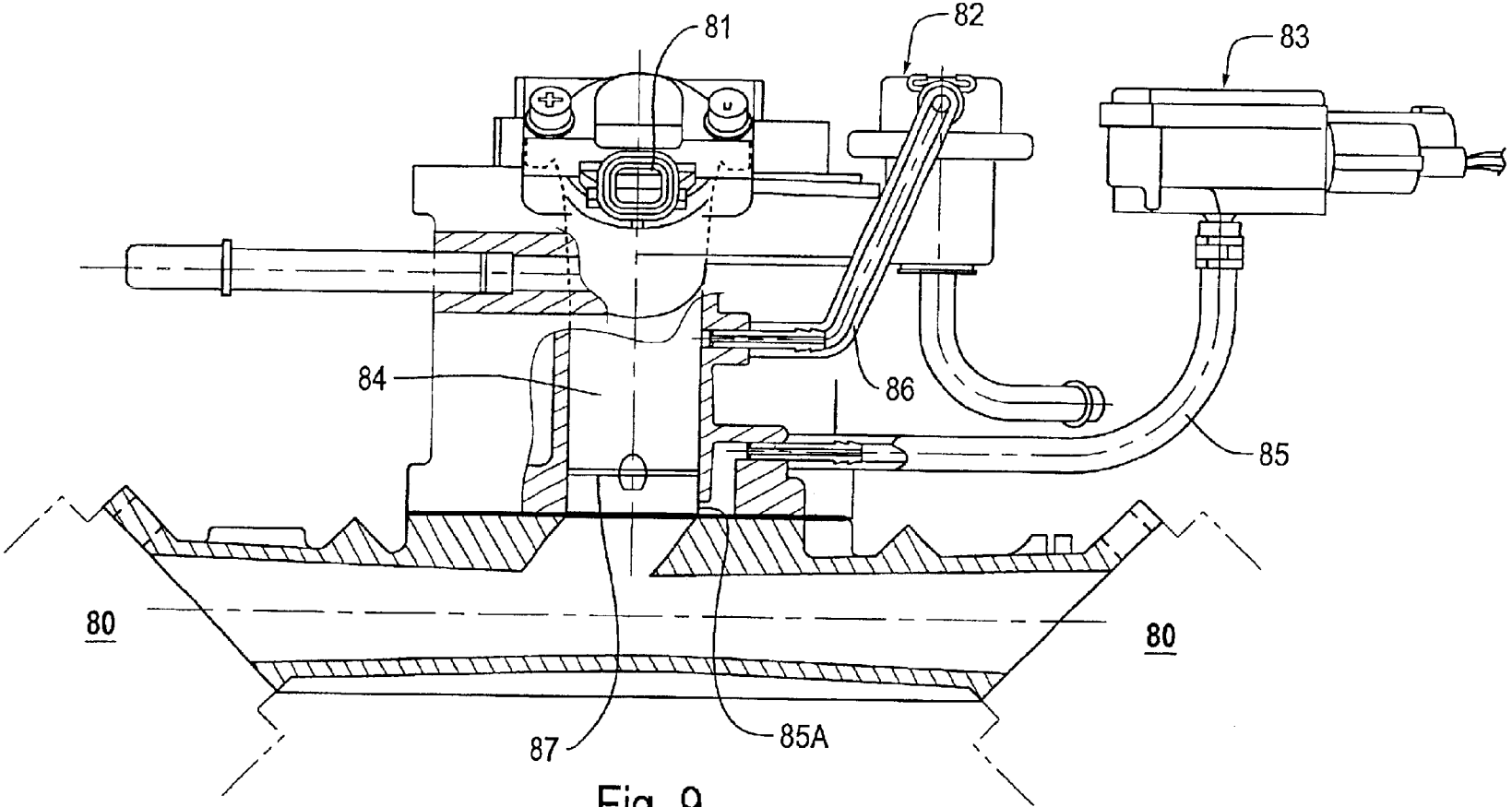
Fig. 9 CONVENTIONAL ART
FIG. 9 is a sectional view showing a fuel injection device of the conventional industrial engine.

Concerning the pressure sensor C of FIG. 7, moreover, the detected vacuum value is so stabilized in the waveform of the pressure fluctuations by the existence of the throttle portion 18*b* disposed in the vacuum inlet passage 18 that the peak value and the bottom value become clear, as illustrated in FIG. 8(A). Therefore, the fuel injection rate can be adjusted to establish a desired air/fuel ratio. Without the throttle portion, as illustrated in FIG. 8(B), the pressure fluctuations are made unstable by the influences of the dynamic pressure so that the peak value and the bottom value become unclear, resulting in failure to establish the desired air/fuel ratio.

Here, the embodiment thus far described has been exemplified especially by the V-type 2-cylinder engine, but the present invention can be similarly applied to all other multiple cylinder engines.

Numerous modifications and alternative embodiments of the present invention will be apparent to those skilled in the art in view of the foregoing description. Accordingly, this description is to be construed as illustrative only, and is provided for the purpose of teaching those skilled in the art the best mode carrying out the invention. The detail of the structure and/or function may be varied substantially without departing from the spirit of the invention and all modification which come within the scope of the appended claims are reserved.

What is claimed is:

1. A multiple cylinder engine comprising:

a plurality of cylinders;

a plurality of intake passages, each independently feeding intake air to individual ones of said plurality of cylinders;

a fuel injector disposed in each said intake passage;

a throttle valve disposed in each said intake passage;

a pressure sensor for detecting the pressure of one of said intake passages; and fuel control means for controlling the injection quantity of said fuel injector of each said cylinder by using the detected pressure, wherein an intake manifold connects a throttle body forming a portion of said intake passage and an intake port of said cylinders, the throttle body including said throttle valve, and wherein a vacuum inlet passage is formed in said throttle body and an outlet portion of the vacuum passage is formed in said throttle body at a mating face with said intake manifold.

2. A multiple cylinder engine according to claim 1, further comprising:

a fuel pressure adjustor for adjusting pressure of fuel to be fed to said fuel injectors, wherein one of said throttle body and said intake manifold is formed with a pressure introduction passage that introduces pressure of said each intake passage into said fuel pressure adjustor, and wherein said pressure introduction passage has its leading end portion positioned at the mating face between said throttle body and said intake manifold.

3. A multiple cylinder engine according to claim 2, wherein said leading end portion includes an expansion chamber and an introduction port for connecting said expansion chamber to each said intake passage, and wherein said introduction port has a passage are set smaller than a maximum passage area of said expansion chamber.

4. A multiple cylinder engine comprising:

a plurality of cylinders;

a plurality of intake passages, each independently feeding intake air to individual ones of said plurality of cylinders;

a fuel injector disposed in each said intake passage;

a throttle valve disposed in each intake passage;

a throttle body forming a portion of said intake passage, the throttle body including said throttle valve;

an intake manifold connecting said throttle body to an intake port of said cylinders;

a fuel pressure adjustor for adjusting pressure of fuel to be fed to said fuel injector; and a pressure introduction passage that introduces pressure of said each intake passage into said fuel pressure adjustor, the pressure introduction passage including an expansion chamber and introduction ports for connecting said expansion chamber to each said intake passage, wherein each said introduction port has a passage area set smaller than a maximum passage area of said expansion chamber, each said introduction port is connected independently to said expansion chamber, and said introduction port and said expansion chamber are formed at a mating face between said throttle body and said intake manifold.

5. A multiple cylinder engine according to claim 4, further comprising:

a pressure sensor for detecting the pressure of one of said intake passages; and fuel control means for controlling the injection quantity of said fuel injector of each said cylinder by using the detected pressure.

6. A multiple cylinder engine according to claim 4, wherein said multiple cylinder engine is a V-type 2-cylinder engine having a V space between cylinders, and wherein said fuel pressure adjustor is disposed above said throttle body and in said V space.

* * * * *